US008048269B2

(12) United States Patent
Poikolainen et al.

(10) Patent No.: US 8,048,269 B2
(45) Date of Patent: Nov. 1, 2011

(54) FORMING SECTION

(75) Inventors: Antti Poikolainen, Jyväskylä (FI); Janne Laakso, Jyväskylä (FI); Janne Lappi, Lievestuore (FI)

(73) Assignee: Metso Paper, Inc., Helsinki (FI)

( * ) Notice: Subject to any disclaimer, the term of this patent is extended or adjusted under 35 U.S.C. 154(b) by 389 days.

(21) Appl. No.: 12/306,683

(22) PCT Filed: Jun. 12, 2007

(86) PCT No.: PCT/FI2007/050348

§ 371 (c)(1),
(2), (4) Date: Dec. 24, 2008

(87) PCT Pub. No.: WO2008/000900

PCT Pub. Date: Jan. 3, 2008

(65) Prior Publication Data

US 2009/0258149 A1 Oct. 15, 2009

(30) Foreign Application Priority Data

Jun. 28, 2006 (FI) ..... 20065446

(51) Int. Cl.
*D21F 1/52* (2006.01)
*D21F 11/02* (2006.01)

(52) U.S. Cl. ..... 162/203; 162/211; 162/217; 162/300; 162/301; 162/303; 162/352

(58) Field of Classification Search ..... 162/298, 162/299, 300, 303, 304, 211, 351, 352, 374, 162/132, 133, 203, 217
See application file for complete search history.

(56) References Cited

U.S. PATENT DOCUMENTS

| | | | | |
|---|---|---|---|---|
| 4,154,645 | A | 5/1979 | Kankaanpää | |
| 5,599,427 | A | 2/1997 | Koivuranta et al. | |
| 6,372,091 | B2 * | 4/2002 | Wildfong et al. | 162/301 |
| 7,364,643 | B2 * | 4/2008 | Poikolainen et al. | 162/203 |
| 2002/0108732 | A1 | 8/2002 | Grabsoheid et al. | |

(Continued)

FOREIGN PATENT DOCUMENTS

DE 2055827 5/1972

(Continued)

OTHER PUBLICATIONS

Written Opinion issued in PCT/FI2007/050348.

(Continued)

*Primary Examiner* — Eric Hug
(74) *Attorney, Agent, or Firm* — Stiennon & Stiennon

(57) ABSTRACT

A forming section has a lower wire loop (11), which constitutes a single-wire section (T) following a breast roll (12). A first dewatering zone (Z1) has at least one stationary, first forming shoe (40) followed by a pulsating strip cover (50). The first forming shoe has leading and trailing edges and underpressure affecting through holes of the cover. The holes are openings or slots substantially in the longitudinal direction of the machine, whereby non-pulsating dewatering is applied on the stock travelling on top of the lower wire. A pulp suspension jet is fed from a headbox (30) at an impact point after the shoe leading edge. The cover is straight at least in the area between the impact point of the pulp suspension jet and the trailing edge. The impact of the pulp suspension jet on the forming wire is thus better controlled in a better way, increasing production speed.

20 Claims, 7 Drawing Sheets

U.S. PATENT DOCUMENTS

| | | | | |
|---|---|---|---|---|
| 2003/0173048 | A1 * | 9/2003 | Buchanan et al. | 162/352 |
| 2007/0163736 | A1 * | 7/2007 | Raisanen et al. | 162/132 |

FOREIGN PATENT DOCUMENTS

| | | | |
|---|---|---|---|
| DE | 10009535 | A1 | 9/2000 |
| EP | 0627523 | A1 | 12/1994 |
| FI | 70739 | B | 6/1986 |
| FI | 990432 | A | 9/2000 |
| FI | 116628 | B | 8/2005 |
| WO | 2004/018768 | A1 | 3/2004 |
| WO | 2005/078187 | A1 | 8/2005 |
| WO | 2005/078188 | A1 | 8/2005 |
| WO | 2008/000900 | A1 | 1/2008 |

OTHER PUBLICATIONS

Search Report issued in PCT/FI2007/050348.
Search Report issued in FI 20065446.

* cited by examiner

FORMING SECTION

CROSS REFERENCES TO RELATED APPLICATIONS

This application is a U.S. national stage application of International App. No. PCT/FI2007/050348, filed Jun. 12, 2007, the disclosure of which is incorporated by reference herein, and claims priority on Finnish App. No. 20065446 filed Jun. 28, 2006.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a method on a forming section and a forming section.

The task of a forming section is to remove water from fiber suspension fed by the headbox. The consistency of the fiber suspension fed onto the forming section is usually 1% and, after the forming section, the consistency of the web formed on the forming section is, for its part, 18-20%.

When the web is manufactured of watery wood fiber stock, water in the pulp is removed on the forming section through a forming wire or forming wires for starting the formation of the web. Wood pulp fibers remain randomly distributed on the forming wire or between forming wires moving together.

Depending on the grade of the web being manufactured, different types of stocks are used. The amount of water that can be removed from different stocks for achieving a web of good quality is a function of many factors, such as e.g. a function of the desired basis weight of the web, the design speed of the machine, and the desired level of fines, fibers and fill materials in the finished product.

Many types of devices are known on the forming section i.e. former of the web, such as foil strips, suction boxes, hitch rolls, suction rolls, and rolls provided with an open surface, which have been used in many different arrangements and arrays when trying to optimize the amount, time and location of water being removed when forming the web. The manufacture of the web is still partly art and partly science in simply that removing water as quickly as possible does not produce an end-product of best quality. In other words, manufacturing a high-quality end-product especially with great speeds is a function of the amount of dewatering, the dewatering method, the duration of dewatering and the location of dewatering.

When it is desired to maintain or improve the quality of the end-product when transferring to higher production speeds, many times unforeseeable problems are created as the result of which either the production volume has to be decreased for maintaining the desired quality or the desired quality has to be sacrificed for achieving the greater production volume.

A forming section known from prior art is a hybrid former consisting of a single-wire section and a twin-wire section following it, whereby a lower wire forms a second wire of the twin-wire section. The headbox feeds a pulp suspension jet at the beginning of the single-wire section, after which the pulp layer, having received its initial forming on the lower wire, moves onto the twin-wire section in which the formation of the web is continued. On the single-wire section, the web is dewatered only in one direction i.e. through the lower wire and, on the twin-wire section, the web is dewatered in both directions.

The hybrid former can be used in a relatively large basis-weight range, whereby it is possible by means of it to e.g. manufacture fine paper the basis weight of which is in the range of 150-300 g/m$^2$. With a gap former, it is usually not possible to manufacture a web the basis weight of which exceeds the value of 200 g/m$^2$. Thus, there are still a lot of hybrid formers in use and some old fourdrinier-wire formers are modified into hybrid formers.

A problem related to the hybrid former is that the residual variation of the web formed is dependent on the speed of the machine. The upper limit of the speed range of best hybrid formers today is about 1,300 m/min. If the speed of the hybrid former is increased to the value of over 1,300 m/min, also the residual variation of the web formed increases strongly. A web having too large a residual variation is not a saleable product.

FIG. 7 of WO publication 2004/018768 shows a hybrid former according to prior art. The headbox feeds a pulp suspension jet onto a lower wire at the beginning of a single-wire section on top of a breast roll or immediately after it. On the single-wire section, the web is dewatered only in one direction with dewatering devices which can comprise e.g. dewatering strips combined with underpressure or without underpressure, different suction boxes, forming shoes or other equivalents. The single-wire section is followed by a twin-wire section at the beginning of which an upper wire loop forms a gap with the lower wire. Within the upper wire loop, there is a suction box which is divided into three successive compartments in which unequal underpressures can be used. The lower surface of the first compartment of the suction box following the gap of the twin-wire section is constituted of a curvilinear, stationary forming shoe provided with through holes.

FI patent publication 990432 describes a hybrid former in which there is a short single-wire section, which is followed by a twin-wire zone formed between a lower wire loop and an upper wire loop. A slice-lip-adjusted headbox and a breast roll of the fourdrinier wire, which is an open roll, are located so that the headbox feeds a pulp suspension jet at a very small angle onto the fourdrinier wire at the point of the breast roll or in the travel direction of the web after the breast roll. The length of the fourdrinier-wire section is advantageously 0.7-3.0 m. The distance between a vertical plane passing through the central axis of the breast roll and the outmost point of the lip channel of the headbox is 150-250 mm. The height difference between the upper surface of the lower lip of the headbox and the topmost point of the breast roll is 0-10 mm. The impact angle of the headbox jet in relation to the travel direction of the fourdrinier wire is 0-2 degrees.

An article by P. Nyberg and A. Malashenko, "Dilution Control Headbox—Choices, Threats, and Solutions," published in the Proceedings of the 83rd Annual Meeting, Technical Section, CPPA, Montreal, Canada, January 1997, describes a dilution-adjusted headbox and advantages acquired by it. With a dilution-adjusted headbox, a more effective adjustment of basis weight and fiber orientation are achieved in comparison with a traditional slice-lip-adjusted headbox. The basis weight and the fiber orientation can be adjusted independent of each other and considerably more accurately, whereby variations normally occurring in process parameters can be compensated effectively.

FI patent 116628 describes a forming section of a multi-layer web. FIG. 1 shows a hybrid former in which there is a fourdrinier-wire section and a twin-wire section following it.

At the beginning of the fourdrinier-wire section, a first headbox feeds a pulp suspension jet onto the fourdrinier wire and, at the beginning of the twin-wire section, a second headbox feeds a pulp suspension jet on top of a pulp layer travelling on the fourdrinier wire. At the beginning of the fourdrinier-wire section, there is a non-pulsating dewatering zone which consists of a stationary, curvilinear forming shoe at which the pulp suspension jet of the first headbox impacts, advantageously at the angle of 2-6 degrees, in an area immediately after the leading edge of the curvilinear forming shoe. Before the beginning of the twin-wire section, there is a non-pulsating dewatering zone which also consists of a stationary, curvilinear forming shoe at the point of which the pulp suspension jet of the second headbox impacts on the pulp layer travelling on top of the fourdrinier wire. At the beginning of the twin-wire section, there is a non-pulsating dewatering zone consisting of a stationary, curvilinear forming shoe which zone is followed by a pulsating dewatering zone constituted of dewatering strips. In the forming shoes, there is a curvilinear cover provided with holes and possibly underpressure arranged below the cover. In test runs, it has been observed that guiding the lip jet of the headbox with a high speed onto the curvilinear cover constitutes a problem.

FI patent 70739 describes a web-forming unit for manufacturing a paper web. Within a forming wire loop, there are a breast roll and a forming roll. On a section between the breast roll and the forming roll below the forming wire, there are a forming board and a combination of a wet suction box and a wire guiding shoe following it. The headbox feeds a pulp suspension jet on top of the fourdrinier wire on the section following the breast roll. The cover structure of the forming board below the forming wire can be closed, perforated or strip covered. The surface of the forming board is most suitably planar. Dewatering with an open-surfaced forming board takes place most suitably freely, but also a suction effect can be combined with this.

A problem related to arrangements according to prior art is that the formation and the tensile strength ratio of the web are strongly dependent on the jet-wire ratio. An optimum has to be searched for the characteristics of the web in relation to both formation and tensile strength ratio and usually the situation is such that the optima of both factors are not realized with a certain jet-wire ratio. Then one ends up with a compromise in which with higher tensile strength ratios one has to be satisfied with weaker formation.

In the arrangements according to prior art, it is important that the impact point of the lip jet of the headbox can be accurately adjusted to the same point with each run speed. The lip jet impacts in the arrangements according to prior art in the area of the wire in which there are no dewatering strips below the wire, whereby one has to be able to guide the lip jet accurately in the area in question. As the location of the headbox cannot be moved in the machine direction, the location of the impact point of the lip jet is adjusted by adjusting the position of the upper lip of the headbox in the machine direction.

SUMMARY OF THE INVENTION

The arrangement according to the invention provides a surprising effect as the result of which the characteristics of the web are improved and the production speed of the machine can be increased. In the invention, the impact of the lip jet on the forming wire of the forming section is controlled in a better way.

On the forming section according to the invention, a traditional forming board on the single-wire section is replaced by a stationary, straight-covered forming shoe and a strip cover following it. By using a non-pulsating, straight-covered forming shoe provided with suction at the beginning of the forming board, the take-off and beading (stock jump) of the pulp jet can be substantially decreased, because the pulp jet lands on a non-pulsating surface having a large open area. The immediate start of dewatering directly at the impact point damps impact energy. The head of the forming board does not doctor water and does not, for its part, cause stock jump. Also the direction of the jet is flexible.

The arrangement according to the invention enables an extremely good formation of the web in a wide range of jet-wire ratio. A straight-covered forming shoe "freezes" the lip jet of the headbox and differences in the speeds of the lip jet/wires of the headbox do not affect formation so strongly. Then, the formation does not weaken with jet-wire ratios, which differ a lot from a so-called equal headbox situation in which the speed of the lip jet of the headbox and the run speed of the wires are equal.

Furthermore, the arrangement according to the invention has been discovered to have an edge wave reducing effect with large slice openings. A straight-covered forming shoe with underpressure "freezes" the lip jet of the headbox, whereby the lip jet does not impact edge rulers on the edges of the wire part. The forming of an edge wave can thus be minimized or eliminated totally.

In the arrangement according to the invention, the impact point of the lip jet of the headbox can vary in the machine direction in the range of 50-200 mm, whereby an upper lip moving in the machine direction is not necessarily required in the headbox for adjusting the impact point of the lip jet. This simplifies the structure of the headbox and makes it sturdy and durable. Furthermore, a headbox provided with an upper lip stationary in the machine direction is cheaper to manufacture than a headbox provided with an upper lip moving in the machine direction. After the change of the slice opening, the operator is not required to go and adjust the impact point of the lip jet on the wire. Thus, the changes of the slice opening can be done from the control room like with a gap former. The lip jet impacts the wire in the arrangement according to the invention in the area of a perforated cover having a certain length located below the wire. Thus, the lip jet would impact a similar landing surface even though it came down 50-200 mm later. The later impact of the lip jet on the wire naturally affects a little the dewatering capacity of the perforated cover, but it can be compensated with a suitable length dimensioning of the cover.

The arrangement according to the invention can be used in a single-wire former and a hybrid former.

The use of the arrangement according to the invention in a hybrid former enables an extremely short single-wire section, because the aim is not to maximize dewatering on the single-wire section. The web can be guided relatively wet on the twin-wire section. Smaller dewatering on the single-wire section also affects the fact that the residual variation of the web decreases.

In an advantageous embodiment according to the invention, the dewatering of the twin-wire section of the hybrid former is both structurally and process-technically a combination of two dewatering elements.

The first dewatering element of the twin-wire section of the hybrid former is a stationary forming shoe provided with a curvilinear cover and holes extending through the cover in which underpressure can be used for adjusting and intensifying dewatering. The aim is that the forming shoe will not cause pulsating dewatering even when the dewatering is intensified with underpressure. It is possible to consider that the forming shoe is a curve of a "stationary roll" provided with an open surface. The cover has a large open area and it is connected by means of holes to an underpressure chamber within the forming shoe. The holes on the cover of the forming shoe are formed so that pulsating dewatering is avoided, which would have been caused if the holes were constituted of cross-machine directional elongated slots. For obtaining this substantially constant pressure, these holes are either openings, slots arranged substantially in the machine direction, waved slots, embossed machine-directional contact surfaces for supporting the fabric above the cover of the shoe etc. The cross-section of the holes can be circular, quadratic, elliptical or polygonal.

The second dewatering element of the twin-wire section of the hybrid former is a pulsating dewatering fitting which comprises stationary cross-machine directional dewatering strips provided with slots, installed on one side of the forming wires. In connection with stationary strips, it is possible to use underpressure, which affects the pulp between the forming wires via the slots between the strips. Into the slots between the stationary dewatering strips, it is additionally possible to position adjustably loaded dewatering strips on the opposite side of the forming wires in relation to the dewatering strips. With these adjustable dewatering strips, the pulsating effect directed at the web is further intensified.

With a non-pulsating forming shoe, it is possible to remove water from a very wet web without breaking the structure of the web, because no peak of underpressure occurs on the delivery side of the stationary forming shoe. With the underpressure connected to the forming shoe, very effective dewatering is provided and, with adjusting the underpressure level, it is possible to affect the dewatering distribution between the upper and lower surface of the web, whereby it is possible to control, inter alia, the fines distribution between the upper and lower surface of the web and the Z-directional symmetry of the web.

The great dewatering capacity of the non-pulsating forming shoe enables that the consistency of the web going onto the twin-wire section can be optimized according to the end-product being manufactured. In the headbox, it is possible to use consistency lower than normal and a lip jet hole larger than normal. Lower feeding consistency improves the formation of the web being formed.

The radius of the non-pulsating forming shoe and the machine directional length of the shoe can be changed according to each intended use in a very large range. The stationary forming shoe can also be constituted of several curves e.g. so that the radius of the forming shoe is larger at the inlet end, but shortens progressively as a spiral curve towards the outlet end. In such a case, the dewatering pressure is no longer constant over the forming shoe, but it still remains non-pulsating. The possibility to change the radius in both above ways and the length of the shoe means that non-pulsating dewatering is quite easily designed suitable for each embodiment.

After the non-pulsating dewatering zone, the web is guided to a pulsating dewatering zone in dry content in which the formation of the web can be improved with pulsating dewatering.

In the combination of the non-pulsating and the pulsating dewatering zone, the balance of formation and retention can be adjusted better and the strength characteristics of the web can be optimized.

By using a forming board constituted of a non-pulsating forming shoe and a pulsating strip cover on the single-wire section and dewatering constituted of a non-pulsating forming shoe and a pulsating strip cover on the twin-wire section, the one-sidedness of the web can be well controlled. The amount of water being removed through the forming shoes can be adjusted by adjusting the underpressure prevailing in the forming shoes. The control of one-sidedness (particularly the lower surface) is important for the SC and LWC grades. The adjustability of dewatering gives a good opportunity to optimize the symmetry of the end-product. The controlled compression of the web is provided with underpressure affecting the surface of the web.

The arrangement according to the invention is also applicable to refurbishings, whereby an existing headbox can be utilized in this new arrangement.

In an advantageous embodiment of the invention, a dilution-adjusted headbox is used by means of which it is possible to further decrease the residual variation occurring on the single-wire section. The breast roll of the single-wire section has been additionally transferred away from the customary position below the lip channel of the headbox to the delivery side of the headbox and it has been lifted so that the height difference of the upper surface of the lower wire travelling on top of the breast roll and the upper surface of the lower lip of the headbox is in the range of 0-10 mm measured at the topmost point of the breast roll. The horizontal distance between the vertical plane drawn through the midpoint of the breast roll and the outmost point of the lip channel of the headbox is in the range of 0-250 mm. The free flight in the air of the pulp suspension jet discharging from the lip channel of the headbox is in the range of 100-500 mm. The impact angle of the pulp suspension jet on the lower wire is in the range of 0-4 degrees. The pulp suspension jet impacts the lower wire at the point of the stationary forming shoe at the beginning of the forming board. With such an arrangement between the headbox and the breast roll and with the stationary, straight-covered forming shoe at the beginning of the forming board, it is ensured that the pulp suspension jet will not be thrown in the air or become beaded (stock jump) when it impacts the lower wire. The straight-covered forming shoe enables a small impact angle of the lip jet of the headbox on the forming wire.

Applying the arrangement according to the invention in a hybrid former enables the increase of speed to the range of 1,500-1,800 m/min without the residual variation of the web increasing too much or the formation weakening too much. The arrangement according to the invention is also well suitable in a situation in which webs of a large range of basis weights are manufactured on the forming section.

The invention will now be described with reference to the figures of the accompanying drawings.

DESCRIPTION OF THE PREFERRED EMBODIMENTS

Figure 1:
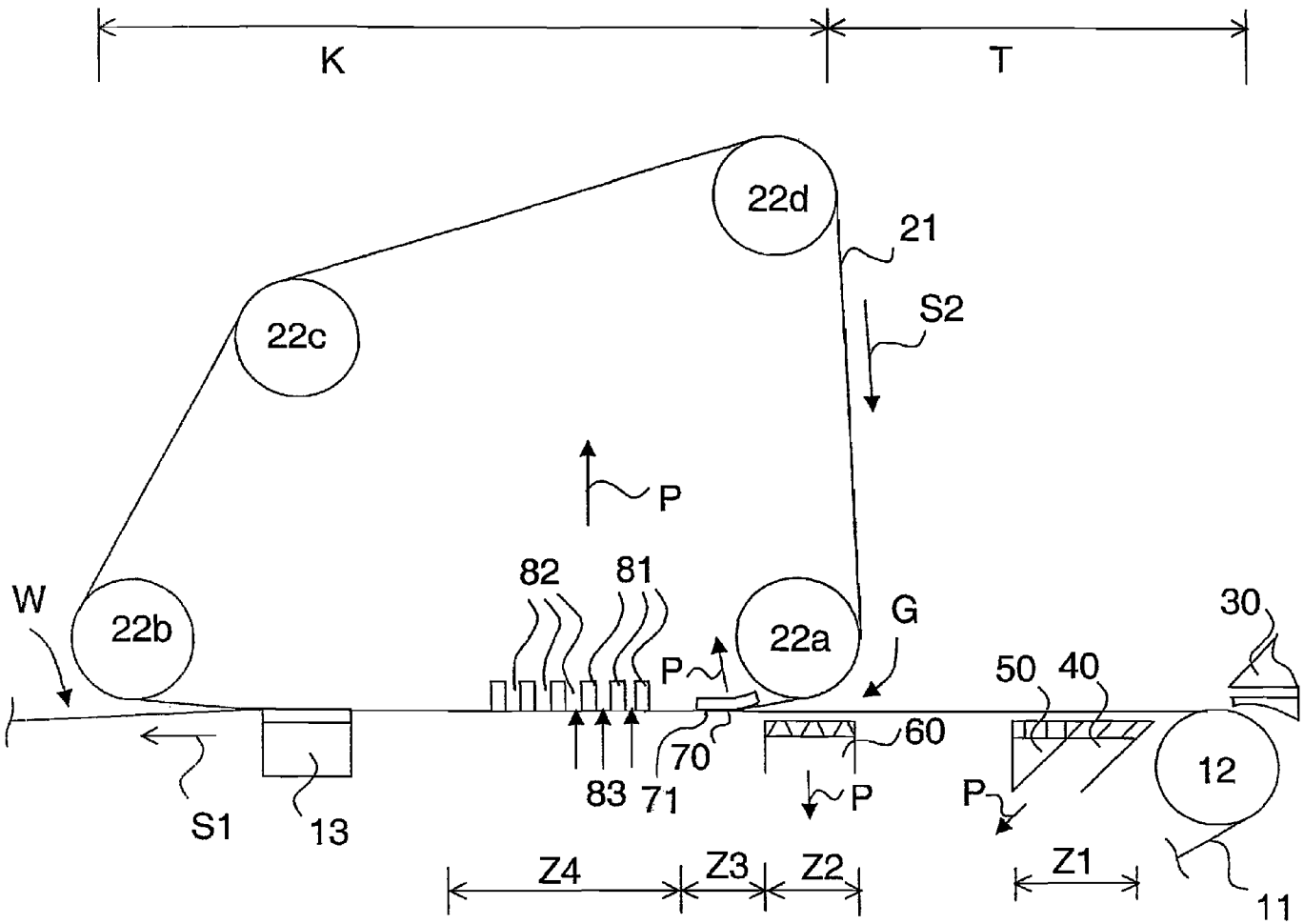
FIG. 1 shows a schematic side view of a hybrid former.

FIG. 1 shows a hybrid former in which there is a single-wire section T and a twin-wire section K following it.

The single-wire section T consists of a lower wire loop 11 and dewatering fittings 40, 50, 60 arranged below the lower wire 11. A headbox 30 feeds a pulp suspension jet onto a first forming shoe 40 positioned at the beginning of the single-wire section on top of the lower wire 11, immediately after a breast roll 12. The travel direction of the lower wire 11 is designated with arrow 51, which is also the machine direction.

The horizontal single-wire section T is followed by the substantially horizontal twin-wire section K. The lower wire 11 constitutes a first wire of the twin-wire section K and a separate upper wire 21 constitutes a second wire. The upper wire 21 has been formed as an endless wire loop by means of hitch and guide rolls 22*a*, 22*b*, 22*c*, 22*d*. The first roll 22*a* of the upper wire loop 21 is arranged above the lower wire 11 so that the upper wire 21 and the lower wire 11 constitute a wedge-shaped gap G at the beginning of the twin-wire section K. The web, which has received its initial forming on the single-wire section T, is guided after this between the lower wire 11 and the upper wire 21 of the twin-wire section K. At the end of the twin-wire section K, the lower wire 11 and the upper wire 21 are separated from each other. The travel direction of the upper wire 21 is designated with arrow S2.

On the single-wire section T, there are two dewatering zones Z1, Z2.

The first dewatering zone Z1 of the single-wire section T is located immediately after the breast roll 12 and it is constituted of the non-pulsating first forming shoe 40 and a pulsating strip cover 50 following it which together constitute a forming board. In the non-pulsating first forming shoe 40, there is a cover provided with holes, which sets against the inner surface of the lower wire 11. The first forming shoe 40 is advantageously connected with a source of underpressure (not shown in the figure), whereby an underpressure effect P is applied to the web via the holes in the cover of the first forming shoe 40. The cover of the first forming shoe 40 is straight at least in the area between the impact point of the pulp suspension jet fed by the headbox and the trailing edge of the cover. The first forming shoe 40 causes non-pulsating dewatering in the stock passing on top of the lower wire 11. With the first forming shoe 40, a lot of water can be removed from the stock.

The second dewatering zone Z2 of the single-wire section T is located at the point of the gap G of the twin-wire section and it consists of a pulsating strip cover 60. The strip cover 60 is connected to a source of underpressure (not shown in the figure), whereby an underpressure effect P is applied to the web passing on top of the lower wire 11 via slots between the cross-machine directional strips of the strip cover 60.

At the beginning of the twin-wire section K, two successive dewatering zones Z3, Z4 are formed.

The first dewatering zone Z3 of the twin-wire section K consists of a second forming shoe 70 in which there is a cover provided with holes which sets against the inner surface of the upper wire 21. The second forming shoe 70 is connected to a source of underpressure (not shown in the figure), whereby an underpressure effect P is applied to the web via the holes in the cover of the second forming shoe 70. The second forming shoe 70 is further arranged so that the stock coming to the gap G of the twin-wire section K on the lower wire 11 will not impact the leading edge of the second forming shoe 70 but will be guided to the area of the cover of the second forming shoe 70 after the leading edge. Thus, the leading edge of the second forming shoe 70 does not remove water from the stock. The second forming shoe 70 causes non-pulsating dewatering in the stock passing between the wires 11, 21. With the second forming shoe 70, a lot of water can be removed from the stock.

The second dewatering zone Z4 of the twin-wire section K consists of stationary and adjustably loadable cross-machine directional dewatering strips 81, 83. The stationary dewatering strips 81 are arranged within the upper wire 21 and between them there are slots 82 via which underpressure P can be applied to the partly formed web between the upper wire 21 and the lower wire 11 for removing water from it. Below the lower wire 11 are arranged the adjustable dewatering strips 83 loaded against the inner surface of the lower wire 11 which strips are located at the points of the slots 82 between the stationary dewatering strips 81. The dewatering strips 81, 83 cause pulsating dewatering to the pulp passing between the wires 11, 21. With this second strongly pulsating dewatering zone Z4 of the twin-wire section K, the formation of the web being formed can be improved.

The second dewatering zone Z4 of the twin-wire section K is followed by a transfer suction box 13 arranged below the lower wire 11 by means of which box it is ensured that the formed web W follows after the twin-wire section K the lower wire 11 from which it is picked up at a pick-up point (not shown in the figure) to further processing.

Figure 2:
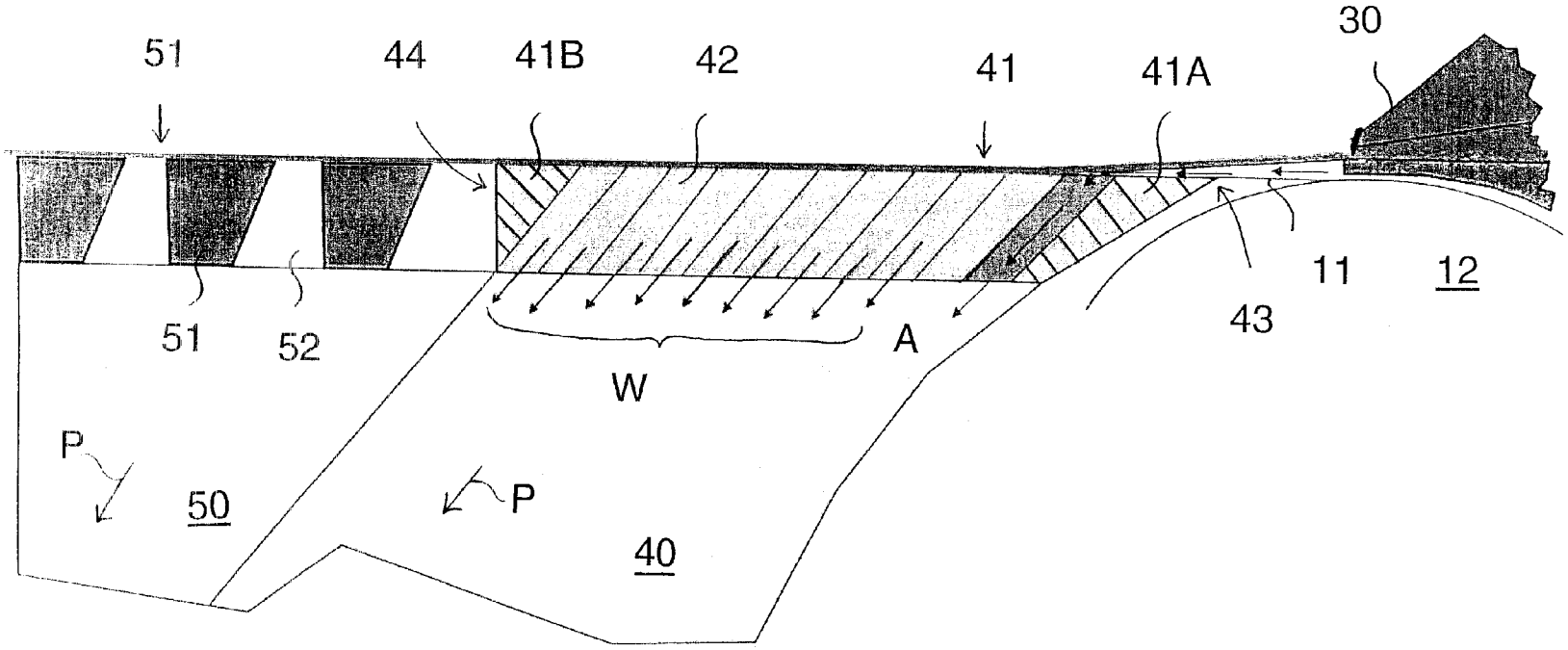
FIG. 2 shows an enlargement of the beginning of a forming section in which the impact of a pulp suspension jet fed by a headbox on a forming board is visible.

FIG. 2 shows an enlargement of the beginning of the single-wire section T in which the headbox 30, the breast roll 12, the first forming shoe 40 and the strip cover 50 are visible. The pulp suspension jet of the headbox 30 impacts the upper surface of the lower wire 11 at the point of the beginning of the first forming shoe 40. On the cover 41 of the first forming shoe 40, there are a leading edge 43 and a trailing edge 44. On the leading edge 43 of the cover 41, there is a first area 41A without holes and, on the trailing edge 44 of the cover 41, there is a second area 41B without holes. Between the areas 41A, 41B without holes of the cover 41, there is an open surface, which consists of holes 42 extending through the cover 41. The holes 42 can consist of openings, grooves, slots or equivalents. Below the cover 41, underpressure P can be arranged by means of which the dewatering of the pulp is intensified. The impact point of the pulp suspension fed by the head-box is located at the beginning of the area with holes 42 after the area 41A without holes of the leading edge 43 of the cover of the first forming shoe 40.

The trailing edge 44 of the first forming shoe 40 is followed by the pulsating strip cover 50 in which there are cross-machine directional strips 51 between which there are openings 52. It is also possible to arrange underpressure P below the strip cover 50 which underpressure affects through the holes 52 and intensifies the dewatering of the pulp. Air A passing along the lower wire 11 is guided through the holes 42 at the beginning of the section with holes of the first forming shoe 40 into the first forming shoe 40 and water W is guided into the forming shoe 40 through the other holes 42 in the first forming shoe 40. For minimizing the impact angle of the pulp suspension jet fed by the headbox, it is possible to use a small angular distortion on the leading edge 43 of the cover 41 of the first forming shoe 40. At the impact point of the pulp suspension jet fed by the headbox and after it, the surface of the cover 41 of the first forming shoe 40 is however straight. The first forming shoe 40 and the strip cover 50 following it together constitute the forming board. The first forming shoe 40 receives the pulp suspension jet of the headbox and quickly slows it down on the surface of the lower wire 11. Simultaneously, the first forming shoe 40 effectively removes water from the web and after this the web can be exposed to the pulsating dewatering of the strip cover 50.

Figure 3:
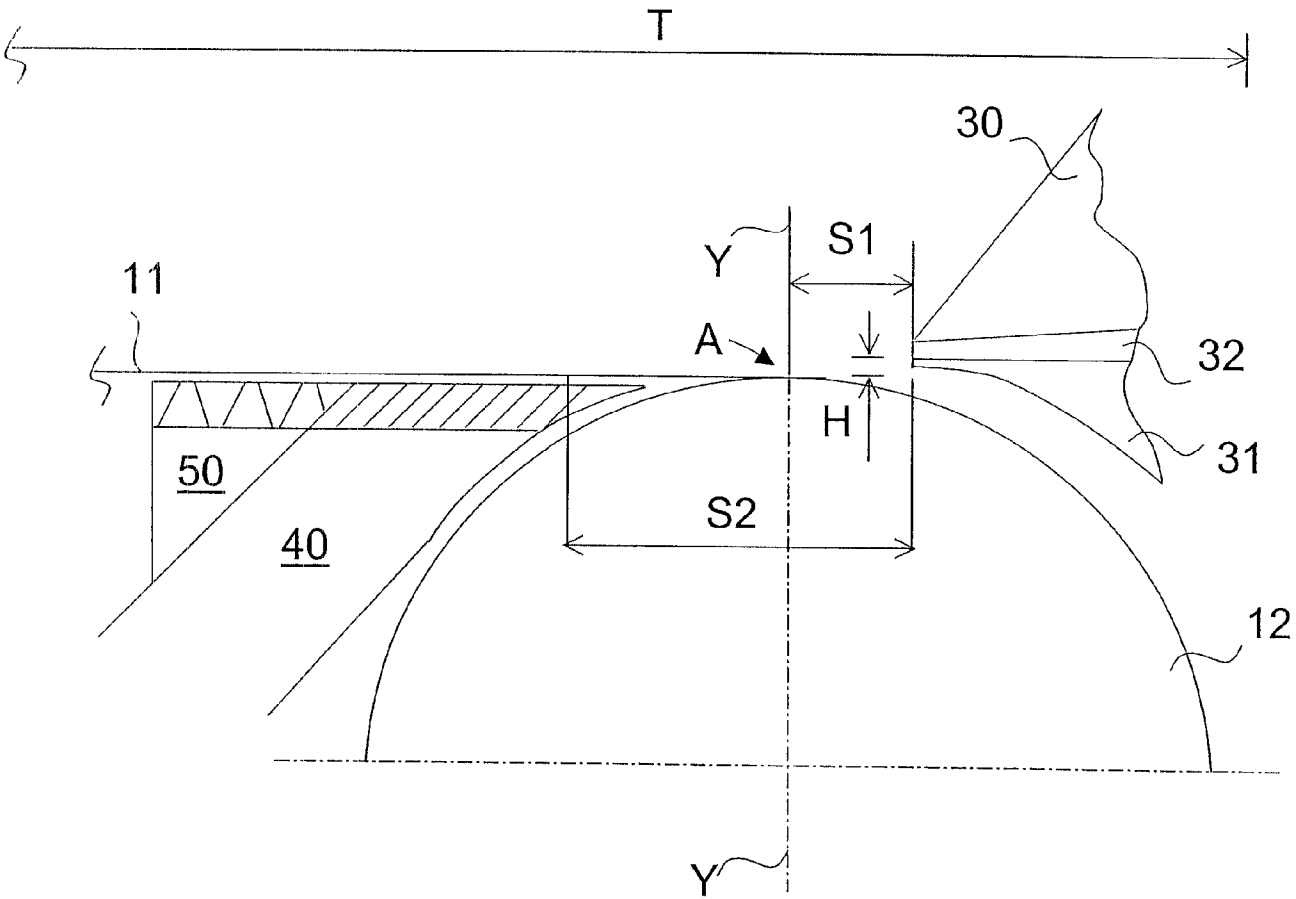
FIG. 3 also shows an enlargement of the beginning of the forming section in which the mutual positioning of a headbox, a breast roll and a forming board is visible.

FIG. 3 shows a second enlargement of the beginning of the single-wire section T in which the mutual positioning of the headbox 30, the breast roll 12, the first forming shoe 40 and the strip cover 50 following it is visible. The breast roll 12 has been transferred away from the customary position below a lip channel 32 of the headbox 30 to the delivery side of the headbox 30 and it has been lifted so that the height difference H of the upper surface of the lower wire 11 travelling on top of the breast roll 12 and the upper surface of a lower lip 31 of the headbox 30 is in the range of 0-10 mm measured at the topmost point A of the breast roll 12. The horizontal distance S1 between the vertical plane Y-Y drawn through the midpoint of the breast roll 12 and the outmost point of the lip channel 32 of the headbox 30 is in the range of 0-250 mm. The free flight in the air S2 of the pulp suspension jet discharging from the lip channel 32 of the headbox 30 is in the range of 100-500 mm. The impact angle of the pulp suspension jet on the lower wire 11 is in the range of 0-4 degrees. The pulp suspension jet impacts the lower wire 11 at the beginning of the area with holes of the first forming shoe 40. Such an arrangement between the headbox 30, the breast roll 12, the first forming shoe 40 and the strip cover 50 following it, assists in that the pulp suspension jet will not be thrown in the air or become beaded (stock jump) when it impacts the lower wire 11.

Figure 4:
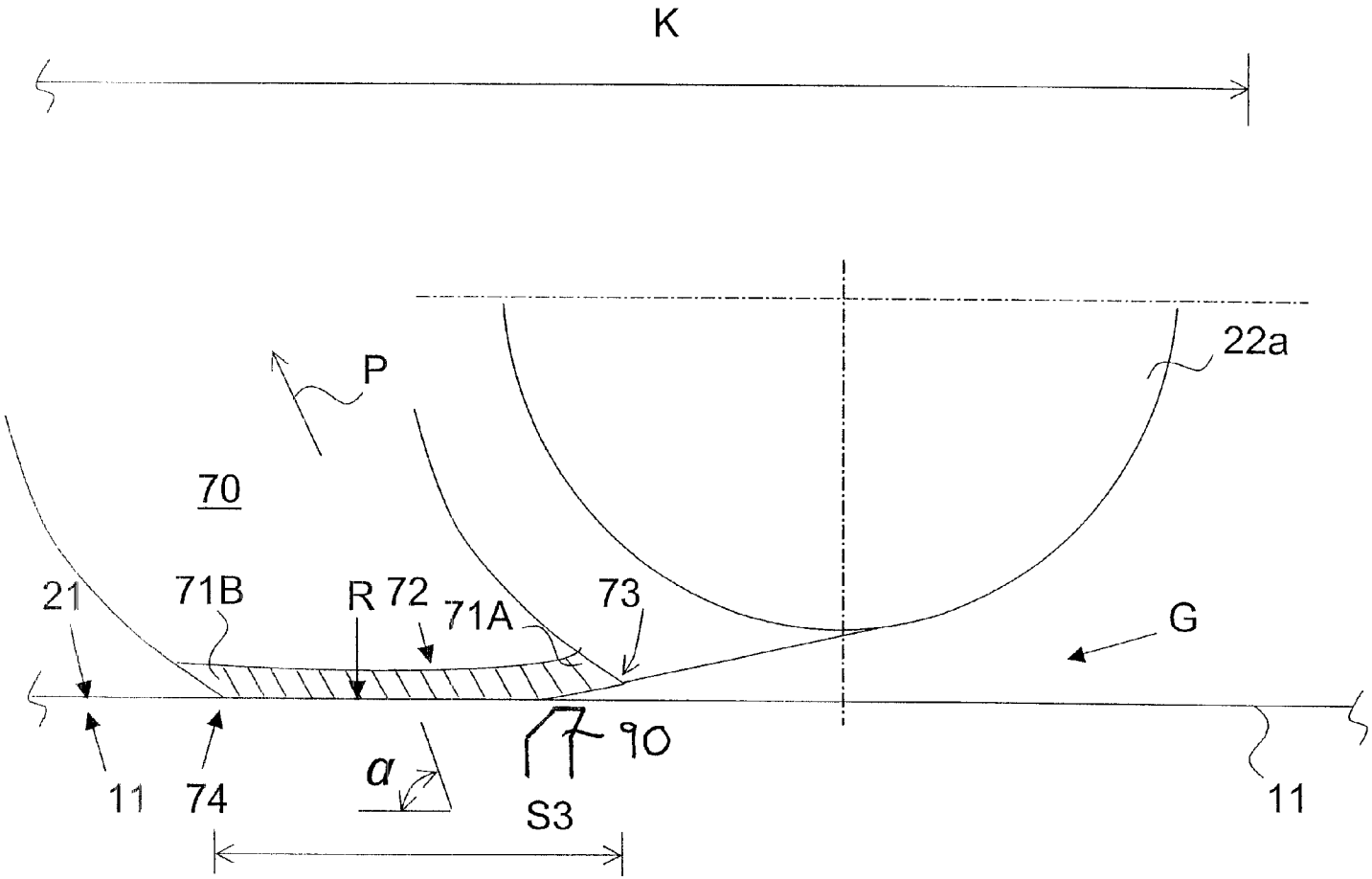
FIG. 4 shows an enlargement of the beginning of a twin-wire section of the hybrid former of FIG. 1.

FIG. 4 shows an enlargement of the beginning of the twin-wire section K of the hybrid former shown in FIG. 1 in which the gap G and the stationary second forming shoe 70 of the twin-wire section K are visible. In the second forming shoe 70, there is a curvilinear cover 71 setting against the inner surface of the upper forming wire 21 in which cover there are a leading edge 73 and a trailing edge 74. On the leading edge 73 of the cover 71, there is a first area 71A without holes and, on the trailing edge 74 of the cover 71, there is a second area 71B without holes. Between the areas 71A, 71B without holes of the cover 71, there is an open surface, which consists of holes 72 extending through the cover 71. The holes 72 can consist of openings, grooves, slots or equivalents. Below the cover 71, underpressure, which is illustrated with an arrow with designation P, is arranged by means of which water is removed from the pulp between the wires 11, 21. The holes 72 are arranged on the cover 71 of the second forming shoe 70 so that the open area of said cover 71 is large, most advantageously 40-90%, and so that they do not cause pressure pulses on the web because of their design and/or arrangement. Pressure pulses can be caused on the web if the forming wire 11, 21 passing on top of the cover 71 is not uniformly supported for the whole area of the cover 71. Pressure pulses are not caused if the holes are constituted of openings or slots substantially in the longitudinal direction of the machine. When the holes 72 are constituted of openings, they are most advantageously arranged against the travel direction S of the wire 11, 21 passing over the cover 71 obliquely in relation to the cover 71 so that water is guided to them better. The angle between the central axis of the holes 72 and the tangent of the outer surface of the cover 71 is in the range of 30-60 degrees. Below the lower wire 11, after the leading edge 73 of the forming shoe 70, there is a support element 90, which is advantageously flexible and/or loadable. The lower wire 11 is not actually deflected by this support element 90, but the support element 90 prevents the vibration of the lower wire 11. An excitation for such vibration can come from the internal operation of the shoe 70 when air and water struggle for the same space. The lower wire 11 is stabilized with the support element 90 and, by adjusting the load of the support element 90, it is possible to guide the air carried along the wires 11, 21 into the gap G from holes following the leading edge 73 of the forming shoe 70 into the forming shoe 70.

The cover 71 of the second forming shoe 70 is formed curvilinear so that the radius of curvature R of the cover 71 is in the range of 1-50 m. The overlap angle of the wire 21 in the area of the cover 71 is in the range of 3-45 degrees, advantageously 5-30 degrees. The machine directional length S3 of the cover 71 is in the range of 200-1,000 mm. The underpressure level used in the second forming shoe 70 is in the range of 0-30 kPa, advantageously in the range of 0-15 kPa. The cover 71 can also consist of several parts having a different radius of curvature R. By changing the radius of curvature R of the cover 71 of the second forming shoe 70 and/or by changing the underpressure P prevailing in the second forming shoe 70 and/or the length S3 of the second forming shoe, the amount and distribution of water removed from the web by the second forming shoe 70 can be adjusted.

Figure 5:
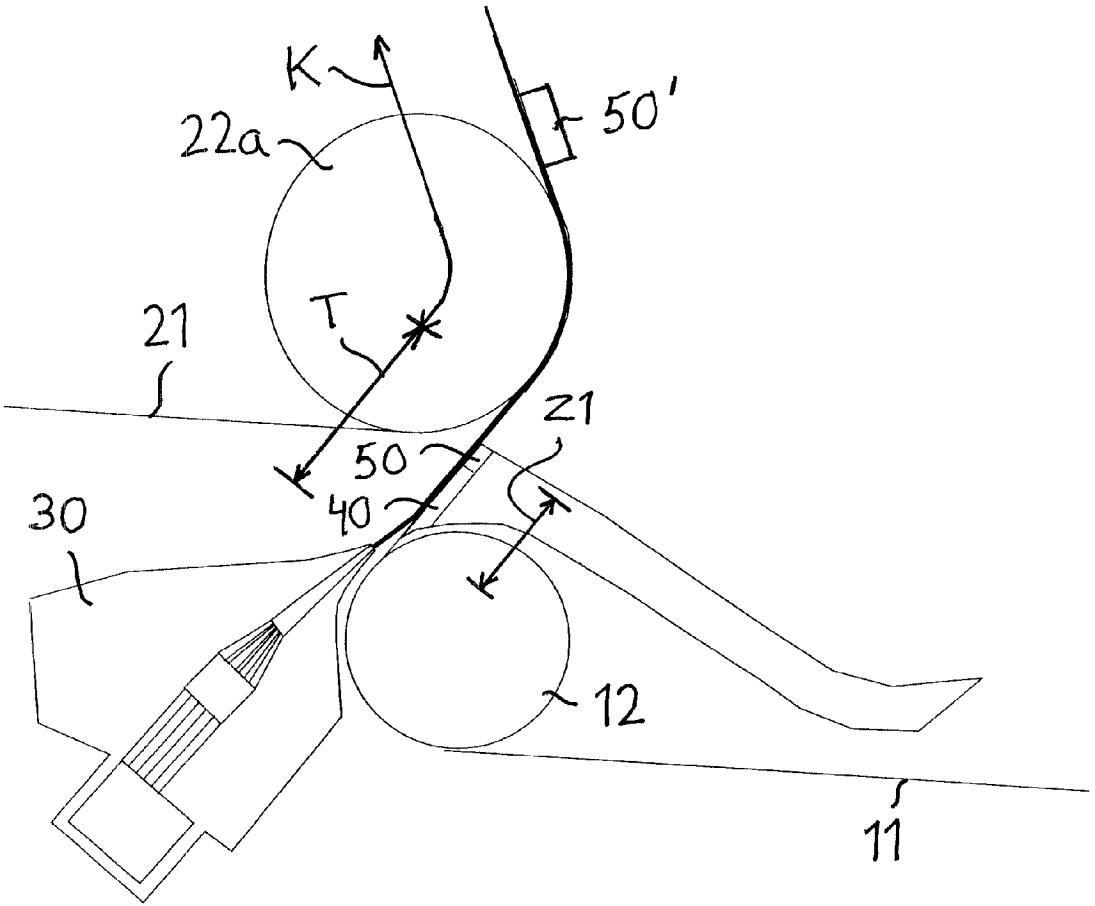
FIG. 5 shows a schematic side view of the beginning of another hybrid former.

FIG. 5 shows a schematic side view of the beginning of another hybrid former. The lower wire 11 circulates over the breast roll 12, which is followed by a short single-wire section. The first dewatering zone Z1 of the single-wire section is located immediately after the breast roll 12 and it entirely corresponds the first dewatering zone of the single-wire section shown in FIG. 1, i.e. there are the first non-pulsating forming shoe 40 and the pulsating strip cover 50 following it. The headbox 30 feeds a pulp suspension jet onto the first forming shoe 40. The cover of the first forming shoe 40 is straight at least in the area between the impact point of the pulp suspension jet fed by the headbox and the trailing edge of the cover. The single-wire section T is followed by the twin-wire section K in which the wires circulate over a forming roll 22*a*. The forming roll 22*a* is advantageously a suction roll. Only the beginning of the twin-wire section K is shown in the figure, and the twin-wire section K can be e.g. a twin-wire section of the type of a normal gap former which is directed either straight or obliquely upwards. The strip cover 50' can alternatively be located after the forming roll 22*a*. Then, non-pulsating dewatering is applied on one side of the web with the forming shoe 40 and non-pulsating dewatering with the forming roll 22*a* on the other, opposite side of the web. The single-wire section T is directed in this embodiment obliquely upwards and the machine-directional length of the single-wire section T can in principle be the length of the forming shoe 40 and in any case less than 1 m. The structural principle of the forming shoe 40 and the strip cover 50 shown in FIG. 2 and the locating principle of the headbox 30 shown in FIG. 3 can also be applied for this embodiment shown in FIG. 5. The coordinates are rotated here so that the straight part of the forming shoe 40 constitutes a reference plane, which corresponds the horizontal plane of FIG. 1.

Figure 6:
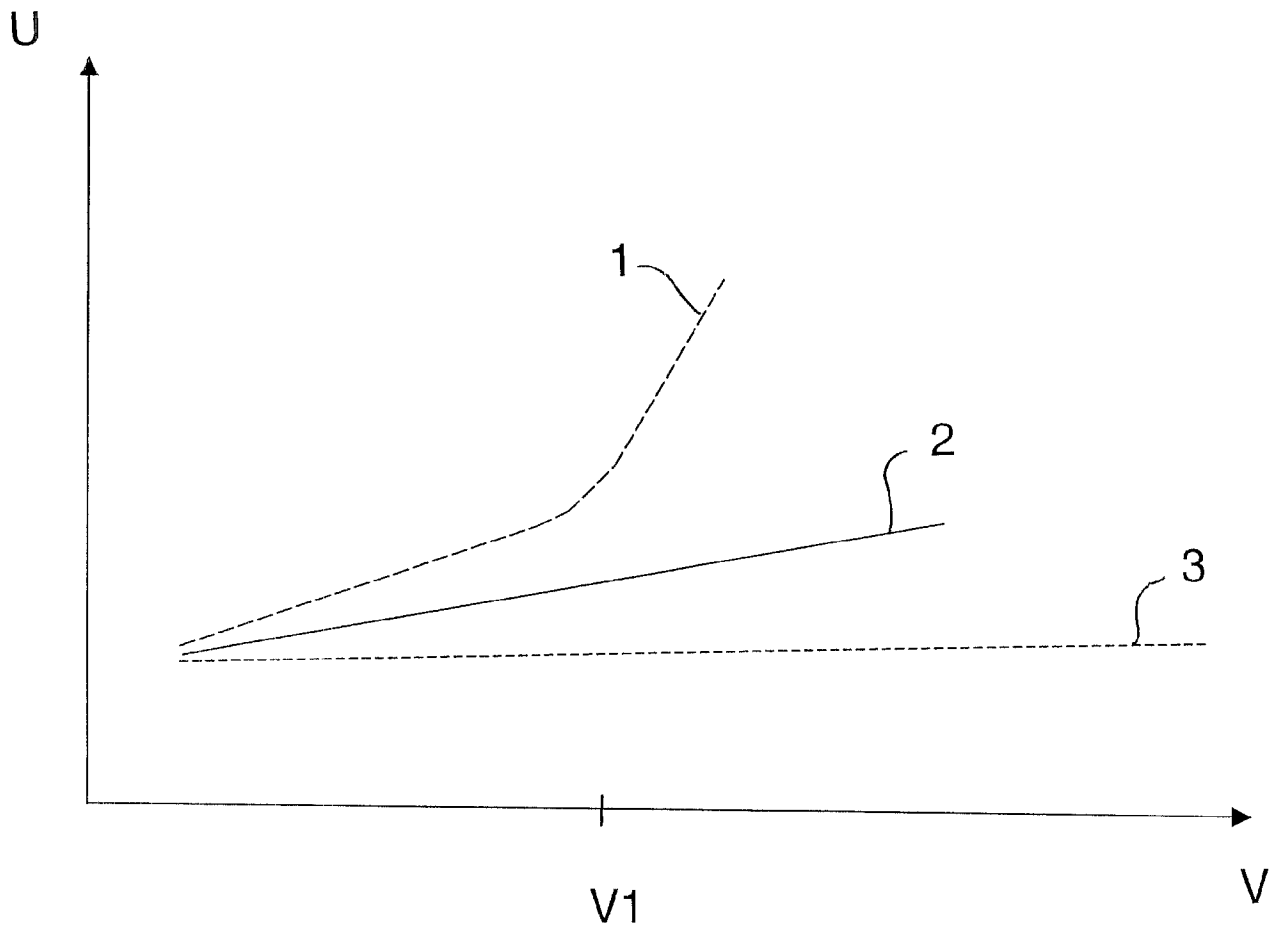
FIG. 6 shows the residual variation of the web formed in a hybrid former and a gap former as a function of speed.

FIG. 6 shows the residual variation of the web formed in a hybrid former and a gap former as a function of speed. Curve 1 depicts the residual variation of a web formed with a hybrid former according to prior art and curve 2 depicts the residual variation of a web formed with a hybrid former applying the arrangement according to the invention. It is evident from the figure that the residual variation of the web formed with the hybrid former according to prior art strongly increases from the point V1 of the horizontal axis onwards in which the point V1 of the horizontal axis corresponds the speed of about 1,300 m/min. Instead in the arrangement according to the invention, the residual variation increases very moderately as the speed increases to more than 1,300 m/min. Curve 3 depicts the residual variation of a web formed with the gap former which variation has not been observed to increase considerably as a function of speed.

Figure 7:
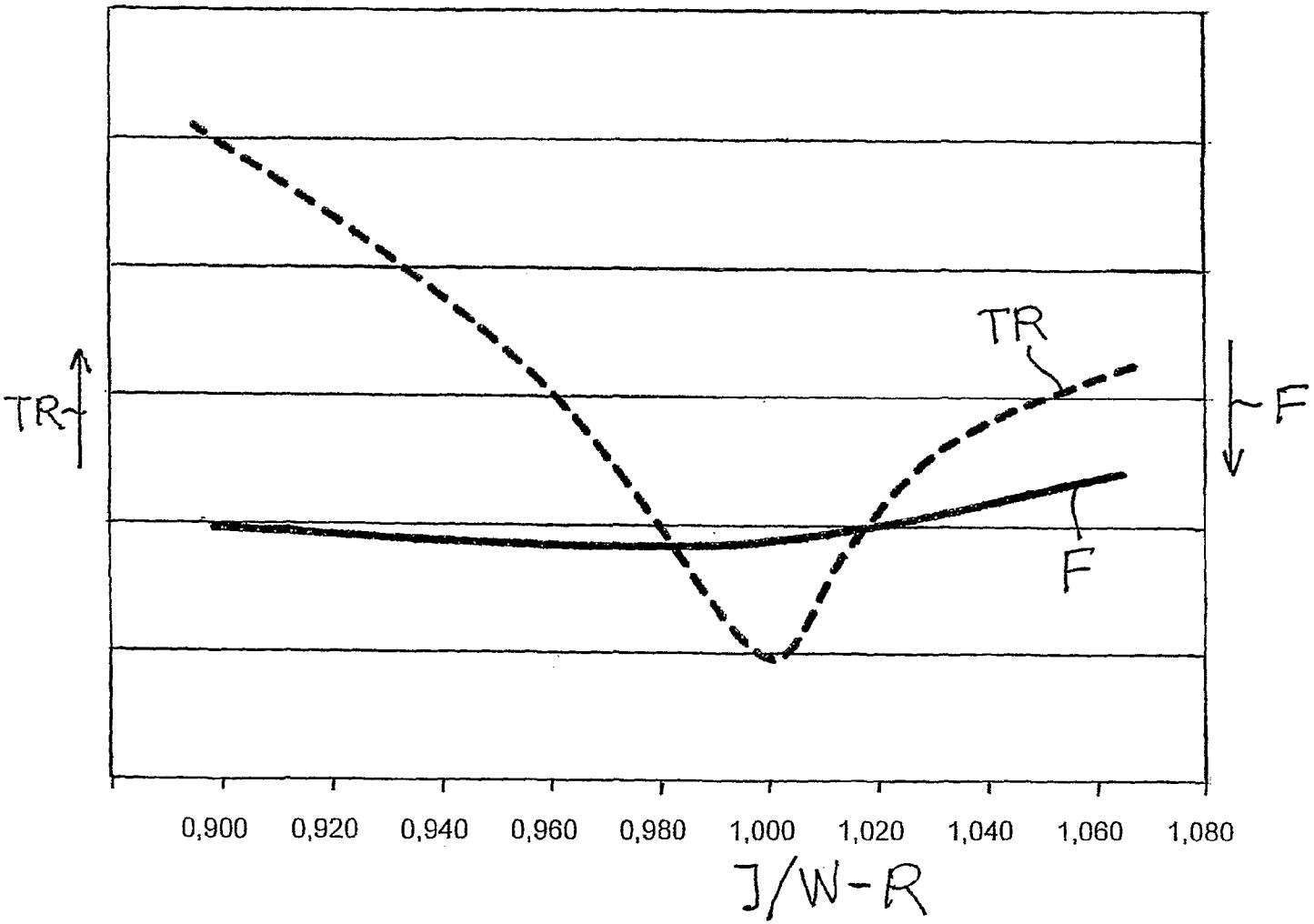
FIG. 7 shows the tensile strength ratio and the formation of the web formed in a hybrid former as a function of jet-wire ratio.

FIG. 7 shows the tensile strength ratio (machine direction/cross direction) TR and the formation F of the web formed in a hybrid former as a function of the jet-wire ratio J/W-R. It is seen from the figure that the formation F remains almost constant as the jet-wire ratio J/W-R i.e. the speed of the jet in relation to the speed of the wire varies in the range of 0.9-1.06. Instead, the tensile strength ratio TR varies more along the variation of the jet-wire ratio J/W-R. The tensile strength ratio TR increases in the direction shown by the arrow and the formation F improves in the direction shown by the arrow. With an arrangement according to the invention, it is thus possible e.g. to use the jet-wire ratio J/W-R of 0.9, whereby a high tensile strength ratio TR of the web is achieved without the formation F of the web weakening considerably. With the arrangement according to the invention, the formation of the web remains good for the whole range of the run window of the jet-wire ratio.

The structure of the first forming shoe 40 on the single-wire section T corresponds the second forming shoe 70 on the twin-wire section K with the difference that the cover of the first forming shoe 40 is straight. The underpressure level used in the first forming shoe 40 is in the range of 0-30 kPa, advantageously in the range of 0-15 kPa.

The machine directional length of the single-wire section T is in the range of 0.5-10.0 m and the consistency of the pulp suspension fed by the headbox 30 is in the range of 0.5-1.5%. With high speeds, the single-wire section has to be short i.e. in the range of 0.5-3.0 m. In refurbishings, the single-wire section is usually due to the existing structure long i.e. in the range of 8-10 m and then it is rarely shortened. A long single-wire section weakens the residual variation of the web. With the arrangement according to the invention, it has been possible to run at the speed of more than 1,600 m/min without the residual variation considerably increasing on a hybrid former with a single-wire section of 8-10 m.

In the embodiment shown in the figures, it is possible to remove from the water volume included in the pulp suspension fed by the headbox 30 on the single-wire section T about 55% downwards and on the twin-wire section K about 30% upwards and about 5% downwards. In a hybrid former applying the arrangement according to the invention, it is possible to achieve relatively uniform dewatering from both surfaces of the web. With a stationary forming shoe at the beginning of the twin-wire section, it is possible to remove a lot of water from a relatively wet web, whereby there is no need to remove so much water on the single-wire section. With the forming shoe, it is possible to remove about half of the total volume of water being removed upwards on the twin-wire section.

Only one forming shoe at the beginning of the single-wire section and the twin-wire section has been shown in the embodiments of the figures, but there can also be several forming shoes, whereby it is possible to e.g. use different underpressure levels in different forming shoes.

The second dewatering zone Z4 of the twin-wire section K in the embodiment shown in the figures consists of stationary 81 and adjustably loadable 83 dewatering strips. The second dewatering zone Z4 of the twin-wire section K can also consist solely of stationary dewatering strips 81. The stationary dewatering strips 81 can form a straight path to the wires travelling on top of them. With underpressure prevailing in the slots 82 of the stationary dewatering strips 81, the path of the wires is slightly deflected in said slots 82, whereby pulsating dewatering is provided in the web between the forming wires. The stationary dewatering strips 81 can also be positioned so that they form a curvilinear path to the wires travelling on top of them. The dewatering strips 81 are then at a small angle of about 0.5-2 degrees in relation to each other. With such an arrangement, intensified pulsating dewatering is provided in the web between the forming wires passing over the dewatering strips. In both cases, the pulsating effect is further intensified if both stationary 81 and adjustably loadable 83 dewatering strips are used.

Above were described only some advantageous embodiments of the invention and it is evident to those skilled in the art that several modifications can be made to them within the scope of the enclosed claims.

The invention claimed is:

1. A method of forming a fiber web comprising the steps of:

feeding a pulp suspension jet of stock from a headbox in a travel direction on to an upper surface of a lower wire of a single-wire forming section;

wherein the pulp suspension jet engages the upper surface of the lower wire at an impact point immediately after a breast roll and over a cover of at least one stationary first forming shoe, said impact point being between a leading edge and a trailing edge of said cover;

non-pulsating dewatering a pulp suspension formed from the pulp suspension jet on the upper surface of the lower wire with an underpressure applied to the pulp suspension through a plurality of through holes defined by portions of the cover of the at least one first forming shoe, the dewatering starting at the impact point, the cover setting against an inner surface of the lower wire, wherein the through holes are openings or slots substantially in a longitudinal direction of the machine;

wherein the non-pulsating dewatering of stock of the pulp suspension takes place over a straight portion of the cover of the at least one first forming shoe which is straight at the impact point and between the impact point and the trailing edge of the at least one stationary first forming shoe; and dewatering the stock with pulsating dewatering over a plurality of stationary cross-machine directional dewatering strips provided with slots therebetween, installed below the lower forming wire following the at least one first forming shoe.

2. The method of claim 1, wherein the cover of the at least one first forming shoe has a leading area without holes at the cover leading edge, and a trailing area without holes at the cover trailing edge, wherein an intermediate area is defined between the leading area and the trailing area having the through holes formed therein, the through holes defining 40-90% of the intermediate area.

3. The method of claim 1 wherein the through holes in the cover of the at least one first forming shoe through which the non-pulsating dewatering is performed are arranged obliquely against the travel direction of the lower wire with an angle between a central axis of the holes and a tangent in the travel direction to an outer surface of the cover of 30-60 degrees.

4. The method of claim 1 wherein the headbox has an upper lip which is stationary in a machine direction.

5. The method of claim 1 wherein dilution is adjusted in the headbox to decrease residual variation occurring in the stock on the upper surface of the lower wire of the single-wire forming section.

6. A method of forming a fiber web comprising the steps of:

feeding a pulp suspension jet of stock from a headbox in a travel direction on to an upper surface of a lower wire of a single-wire forming section;

wherein the pulp suspension jet engages the upper surface of the lower wire at an impact point immediately after a breast roll and over a cover of at least one stationary first forming shoe, said impact point being between a leading edge and a trailing edge of said cover;

non-pulsating dewatering a pulp suspension formed from the pulp suspension jet on the upper surface of the lower wire with an underpressure applied to the pulp suspension through a plurality of through holes defined by portions of the cover of the at least one first forming shoe, the dewatering starting at the impact point, the cover setting against an inner surface of the lower wire, wherein the through holes are openings or slots substantially in a longitudinal direction of the machine;

wherein the non-pulsating dewatering of stock of the pulp suspension takes place over a straight portion of the cover of the at least one first forming shoe between the impact point and the trailing edge of the at least one stationary first forming shoe; and dewatering the stock with pulsating dewatering over a pulsating strip cover following the at least one first forming shoe;

further comprising the steps of:

forming a twin-wire section with the lower wire and a separate upper wire after the single-wire section, in which twin-wire section there is a beginning in which the lower wire and the upper wire constitute a closing gap and an end in which the lower wire and the upper wire are separated from each other;

guiding a web formed from the stock on the single-wire section onto the twin-wire section;

forming at least a first twin wire dewatering zone, and a second successive twin wire dewatering zone in the twin-wire section;

non-pulsating dewatering the web in the first dewatering zone of the twin-wire section with at least one stationary second forming shoe located at the beginning of the twin-wire section and set against the upper wire, the at least one second forming shoe having a curvilinear cover with a curvilinear outer cover surface, a leading edge and a trailing edge, the curvilinear cover including portions between a leading edge and a trailing edge defining through holes which are openings or slots substantially in the longitudinal direction of the machine and defined by portions of the at least one second forming shoe;

carrying out the non-pulsating dewatering of the web by applying underpressure to the through holes of the cover of the at least one stationary second forming shoe to non-pulsating dewater the web which is between the upper wire and the lower wire of the twin-wire section in the area of the cover with the through holes of the second forming shoe, wherein the through holes are such that non-pulsating de-watering is applied to the web; and pulsating dewatering the web in a second dewatering zone of the twin-wire section with stationary cross-machine directional dewatering strips set against one side of the twin-wire section between which strips there are defined slots and applying underpressure to the slots.

7. The method of claim 6 wherein adjustably loadable dewatering strips are arranged in the second dewatering zone of the twin-wire section, which strips are located opposite the slots defined between the stationary dewatering strips, on a second side opposite the one side of the twin-wire section.

8. The method of claim 6, wherein the cover of the at least one second forming shoe has a leading area without holes at the cover leading edge, and a trailing area without holes at the cover trailing edge, wherein an intermediate area is defined between the leading area and the trailing area having the through holes formed therein, the through holes defining 40-90% of the intermediate area.

9. The method of claim 6 wherein the through holes in the cover of the at least one second forming shoe through which the non-pulsating dewatering is performed are arranged obliquely against the travel direction of the lower wire with an angle between a central axis of the holes and a tangent in the travel direction to an outer surface of the cover of 30-60 degrees.

10. The method of claim 6 wherein the non-pulsating dewatering is performed with the at least one second forming shoe so that the overlap angle of the upper wire traveling over the curvilinear outer cover surface of the at least one second forming shoe is 3-45 degrees.

11. A forming section, comprising:

a breast roll within and wrapped by a wire loop formed of a lower wire, the wire loop having an inner surface, and wherein the wire loop forms, a single-wire section as the lower wire extends away from the breast roll, the single-wire section defining a beginning of the single-wire section as the wire extends away from the breast roll, and a top surface opposite the inner surface;

a first forming shoe forming a first dewatering zone, the first forming shoe positioned at the beginning of the single wire section to engage the inner surface of the wire loop, the first forming shoe having a cover with a leading edge closest to the breast roll and a trailing edge furthest from the breast roll and a cover portion between the leading edge and the trailing edge, the cover portion defining a plurality of through holes formed of openings or slots substantially in a longitudinal direction of the forming section, which are set against the inner surface of the wire loop;

a source of underpressure connected to the plurality of through holes, such that non-pulsating dewatering is applied to stock passing on the top surface of the lower wire where the wire and stock pass over the plurality of through holes of the cover of the first forming shoe;

a plurality of stationary cross-machine directional dewatering strips provided with slots therebetween, installed below the lower forming wire to form a pulsating strip cover following the at least one first forming shoe;

a headbox positioned with respect to the lower wire to supply a jet of pulp suspension to an impact point over the through holes between the leading edge and the trailing edge of the first forming shoe; and the cover of the forming shoe being straight at least between the impact point of the pulp suspension jet and the trailing edge of the forming shoe.

12. The forming section of claim 11, wherein the first forming shoe cover has a leading area without holes at the leading edge of the cover, and a trailing area without holes at the trailing edge of the cover, and an intermediate area is defined between the leading area and the trailing area, and wherein the through holes are located in the intermediate area, and an open area is defined by the total area of the through holes, the open area comprising 40-90% of the intermediate area.

13. The forming section of claim 11 wherein the through holes of the first forming shoe are located obliquely against a travel direction of the lower wire extending from the breast roll to the first forming shoe so that an angle between a central axis of the through holes and a tangent in the travel direction, of the outer surface of the cover is 30-60 degrees.

14. The forming section of claim 11 wherein the headbox has an upper lip not mounted for movement in a machine direction.

15. The forming section of claim 11 wherein the headbox is a dilution-adjustable headbox having a lower lip with an upper surface which is spaced 0-10 mm above the lower wire traveling on top of the breast roll; and wherein the breast roll has a central axis and a vertical plane passing through the central axis and the headbox has a lip channel with an outmost point which is spaced in a horizontal plane 0-250 mm from the vertical plane passing through the central axis of the breast roll.

16. A forming section, comprising:

a breast roll within and wrapped by a wire loop formed of a lower wire, the wire loop having an inner surface, and wherein the wire loop forms a single-wire section as the lower wire extends away from the breast roll, the single-wire section defining a beginning of the single-wire section as the wire extends away from the breast roll, and a top surface opposite the inner surface;

a first forming shoe forming a first dewatering zone the first forming shoe positioned at the beginning of the single wire section to engage the inner surface of the wire loop, the first forming shoe having a cover with a leading edge closest to the breast roll and a trailing edge furthest from the breast roll and a cover portion between the leading edge and the trailing edge, the cover portion defining a plurality of through holes formed of openings or slots substantially in a longitudinal direction of the forming section, which are set against the inner surface of the wire loop;

a source of underpressure connected to the plurality of through holes, such that non-pulsating dewatering is applied to stock passing on the top surface of the lower wire where the wire and stock pass over the plurality of through holes of the cover of the first forming shoe;

a headbox positioned with respect to the lower wire to supply a jet of pulp suspension to an impact point over the through holes between the leading edge and the trailing edge of the first forming shoe;

the cover of the forming shoe being straight at least in an area between the impact point of the pulp suspension jet and the trailing edge of the forming shoe;

and further comprising:

an upper wire forming a loop having an inner surface, the upper wire forming a twin-wire section with the lower wire after the single-wire section, the twin-wire section forming a beginning in which the lower wire and the upper wire come together to form a closing gap and an end where the upper wire and the lower wire separate;

wherein the twin-wire section has at least a first dewatering zone and a successive second dewatering zone;

wherein the first dewatering zone of the twin-wire section has at least one stationary second forming shoe located at the beginning of the twin-wire section, which shoe has a cover with an outer curvilinear cover surface with a leading edge, a trailing edge, and a cover portion provided with through holes set against the inner surface of the upper wire, the through holes being openings or slots substantially in the longitudinal direction of the forming section;

a source of underpressure connected to the through holes of the at least one second forming shoe cover so that non-pulsating dewatering is applied to stock travelling between the forming wires of the twin-wire section and over the holes of the at least one second forming shoe; and wherein the second dewatering zone of the twin-wire section has stationary cross-machine directional dewatering strips set against one side of the twin-wire section, the dewatering strips defining slots therebetween which are connected to a source of underpressure, such that pulsating dewatering is applied to stock traveling between the upper wire and the lower wire of the twin-wire section.

17. The forming section of claim 16, wherein the second dewatering zone of the twin-wire section further comprises adjustably mounted loadable dewatering strips which are located opposite the slots defined between the stationary dewatering strips, and on a second side opposite the one side of the twin-wire section.

18. The forming section of claim 16, wherein the second forming shoe cover has a leading area without holes at the leading edge of the cover, and a trailing area without holes at the trailing edge of the cover, and an intermediate area is defined between the leading area and the trailing area, and wherein the through holes are located in the intermediate area, and an open area is defined by the total area of the through holes, the open area comprising 40-90% of the intermediate area.

19. The forming section of claim 16 wherein the through holes of the second forming shoe are located obliquely against a travel direction of the lower wire extending from the breast roll to the second forming shoe so that an angle between a central axis of the through holes and a tangent in the travel direction of the outer curvilinear cover surface is 30-60 degrees.

20. The forming section of claim 16, wherein an overlap angle of the upper wire traveling over the outer curvilinear cover surface of the second forming shoe is 3-45 degrees.

* * * * *